United States Patent [19]

Shota

[11] Patent Number: 4,668,937

[45] Date of Patent: May 26, 1987

[54] SPEAKER ACTIVATION CONTROL BY MICROCOMPUTER

[75] Inventor: Minoru Shota, Higashiosaka, Japan

[73] Assignee: Sharp Kabushiki Kaisha, Osaka, Japan

[21] Appl. No.: 460,297

[22] Filed: Jan. 24, 1983

[30] Foreign Application Priority Data

Jan. 29, 1982 [JP] Japan ..... 57-12178[U]

[51] Int. Cl.[4] ..... G08B 3/00

[52] U.S. Cl. ..... 340/384 R; 340/384 E

[58] Field of Search ..... 340/384 E, 284 R; 364/705, 710; 331/116 R; 219/10.55 B, 10.55 C, 10.55 M, 10.55 E

[56] References Cited

U.S. PATENT DOCUMENTS 4,164,735 8/1979 Salem ..... 340/384 E
4,334,280 6/1982 McDonald ..... 340/384 E X
4,349,715 9/1982 Mariyama ..... 219/10.55 E
4,488,145 12/1984 Katsuma et al. ..... 340/384 E

*Primary Examiner*—John W. Caldwell, Sr.
*Assistant Examiner*—Tyrone Queen
*Attorney, Agent, or Firm*—Birch, Stewart, Kolasch & Birch

[57] ABSTRACT

A microwave oven includes a piezo-electric speaker for audible announcement purposes and a microcomputer for controlling operations of the microwave oven. The mocrocomputer always develops a frequency signal for activating the piezo-electric speaker. A gate signal is developed from the microcomputer so that the gate signal and the frequency signal are commonly applied to the base electrode of a switching transistor. When the gate signal bears the logic "L", the switching transistor repeats the ON/OFF operation in response to the frequency signal applied thereto. The piezo-electric speaker is connected to the switching transistor, whereby the piezo-electric speaker generates the sound whenever the gate signal bears the logic "L".

20 Claims, 8 Drawing Figures

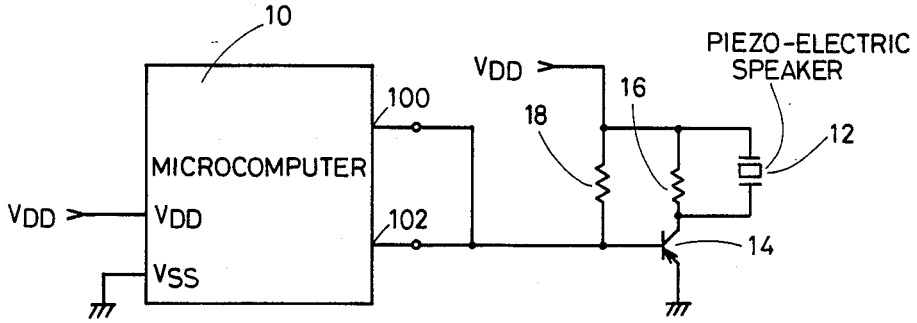
FIG.2
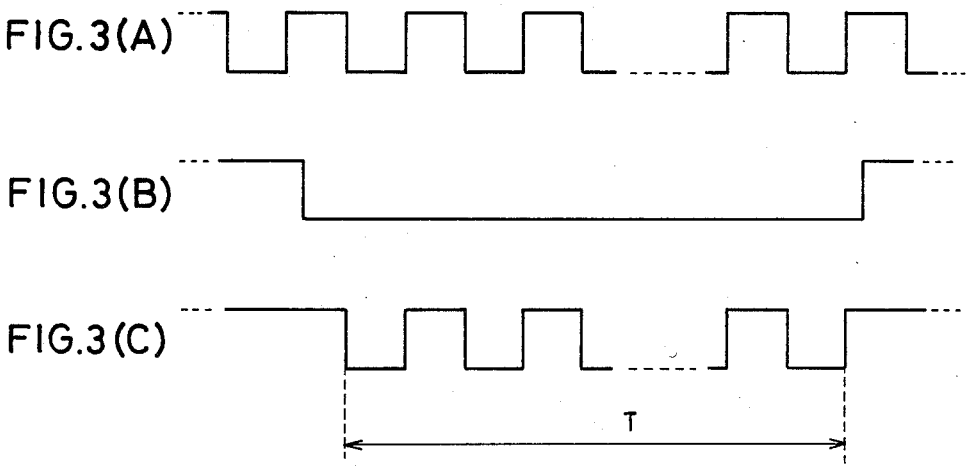

SPEAKER ACTIVATION CONTROL BY MICROCOMPUTER

BACKGROUND AND SUMMARY OF THE INVENTION

The present invention relates to a control system for activating a piezo-electric speaker through the use of output signals derived from a microcomputer.

The present invention relates, more particularly, to a speaker drive control system in a microwave oven which includes a microcomputer as a control circuit.

A microcomputer implemented with a P-channel MOS LSI is widely used in electronic apparatus such as a digital control circuit of a microwave oven because the P-channel MOS microcomputer can directly drive a fluorescent display panel of the dynamic drive type. However, the P-channel MOS microcomputer has a considerably low calculation speed. Therefore, it is difficult to develop a frequency signal for driving a piezo-electric speaker from the P-channel MOS microcomputer while the P-channel MOS microcomputer develops the drive signal to the fluorescent display panel and conducts the time keeping operation for timer operation purposes or for current time keeping purposes.

The piezo-electric speaker is employed in the microwave oven for audibly indicating the cooking completion or for audibly developing a confirmation sound when the key input operation is conducted through a key input panel in order to introduce a cooking source selection signal, cooking temperature set information or cooking time period information.

Accordingly, an object of the present invention is to provide a piezo-electric speaker drive control system which utilizes a control signal developed from a P-channel MOS microcomputer.

Another object of the present invention is to provide a piezo-electric speaker drive system in a microwave oven which includes a digital control system implemented with a P-channel MOS microcomputer.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, two output signals are applied from a microcomputer to a piezo-electric speaker drive system. One signal is a frequency signal for activating a piezo-electric speaker. The other signal is a timing control signal for selectivity applying the frequency signal to the piezo-electric speaker. Since the frequency signal is always developed from the microcomputer, the time period before the piezoelectric speaker is actually activated is considerably reduced.

BRIEF DESCRIPTION OF THE DRAWINGS

The present invention will be better understood from the detailed description given hereinbelow and the accompanying drawings which are given by way of illustration only, and thus are not limitative of the present invention and wherein:

FIG. 2 is a circuit diagram of an embodiment of a piezo-electric speaker drive system of the present invention;

FIGS. 3(A), 3(B) and 3(C) are waveform charts showing various signals occurring within the piezo-electric speaker drive system of FIG. 2.

DESCRIPTION OF THE PREFERRED EMBODIMENTS

Figure 1B:
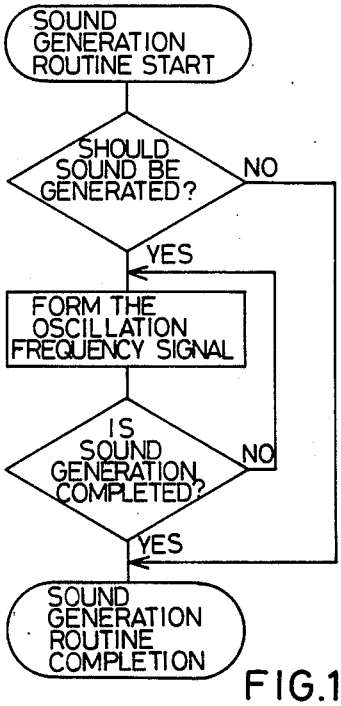
FIG.1(B) PRIOR ART

In the conventional microwave oven controlled by a microcomputer, a sound generation routine is conducted in a manner shown in FIG. 1(B). At the first step of the sound generation routine, a determination is conducted as to whether a sound generation set flag is set or not. If the sound generation set flag is in the set state, the program is advanced to the following step wherein the oscillation frequency signal is formed. Accordingly, a considerably long period of time is required to actually activate the piezo-electric speaker.

The present invention minimizes the time period required between the sound generation instruction and the actual activation of the piezo-electric speaker.

FIG. 2 shows an embodiment of a speaker drive system of the present invention. A microcomputer 10 controls various operations of a microwave oven which includes a piezo-electric speaker 12 for audibly announcing, for example, cooking completion and key input confirmation. Two output terminals 100 and 102 of the microcomputer 10 are connected to the speaker drive system. More specifically, the two output terminals 100 and 102 are commonly connected to the base electrode of a PNP transistor 14. The piezo-electric speaker 12 is disposed between the collector electrode of the PNP transistor 14 and a power supply source $V_{DD}$. A collector resistor 16 is connected to the piezo-electric speaker 12 in a parallel fashion. A pull-up resistor 18 is disposed between the base electrode of the transistor 14 and the power supply source $V_{DD}$.

The first output terminal 100 always develops a signal of a predetermined frequency for driving the piezo-electric speaker 12 as shown in FIG. 3(A). The second output terminal 102 develops a gate signal (FIG. 3(B)) for selectively activating the piezo-electric speaker 12. That is, the base electrode of the PNP transistor 14 receives a composite signal as shown in FIG. 3(C). The PNP transistor 14 is ON when the composite signal (FIG. 3(C)) bears the logic "L". The PNP transistor 14 is OFF when the composite signal (FIG. 3(C)) bears the logic "H". The piezo-electric speaker 12 generates the sound when the PNP transistor 14 repeats the ON/OFF operation with the frequency determined by the signal developed from the first terminal 100. That is, the sound generation is conducted for a period T (FIG. 3(C)) which is determined by the gate signal developed from the second output terminal 102 of the microcomputer 10.

Figure 4A:
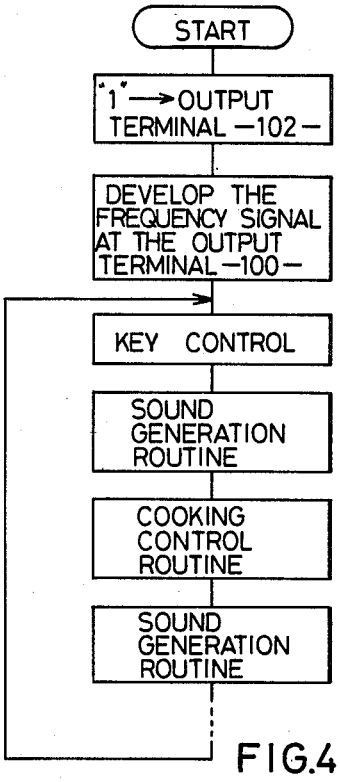
FIGS. 4(A) and 4(B) are flow charts for explaining an operational mode of a microwave oven which includes a digital control system implemented with a microcomputer and the piezo-electric speaker drive system of FIG. 2.
Figure 1A:
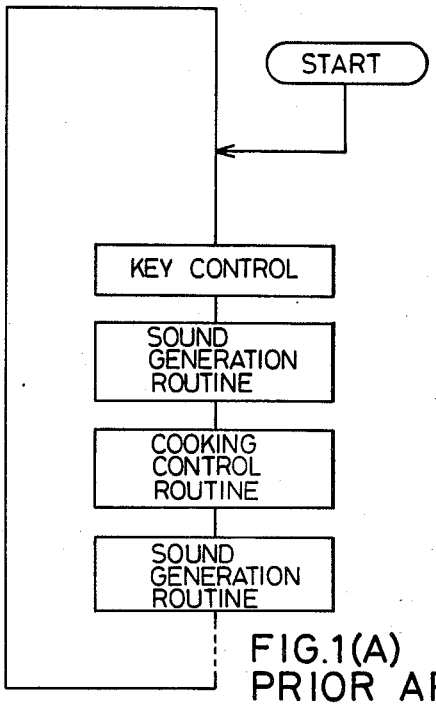
FIG.1(A) PRIOR ART
FIGS. 1(A) and 1(B) are flow charts for explaining an operation mode of a conventional microwave oven which includes a digital control system implemented with a microcomputer.
Figure 4B:
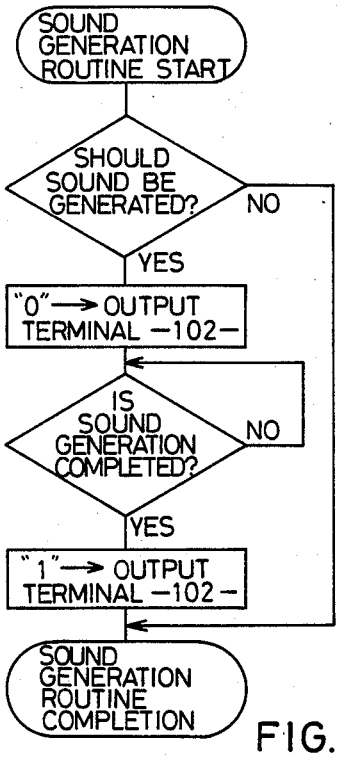

FIGS. 4(A) and 4(B) show an operational mode of a microwave oven including a microcomputer and the speaker drive system of FIG. 2.

As already discussed bove, the frequency signal (FIG. 3(A)) is always developed from the first output terminal 100. At the first step of the sound generation routine, a determination is carried out as to whether the sound generation instruction flag is set or not. If the sound generation instruction is detected, the gate signal (FIG. 3(B) developed from the second output terminal 102 of the microcomputer 10 is changed to the logic "L" for a preselected period of time. When the preselected period of time has passed, the gate signal (FIG. 3(B)) developed from the second output terminal 102 is changed to the logic "H".

Since the frequency signal is always developed from the first output terminal 100 of the microcomputer 10, the program steps are simplified to actually activate the piezo-electric speaker 12.

In a preferred form, the level change of the gate signal from the logic "H" to the logic "L" or from the logic "L" to the logic "H" is conducted at a time when the frequency signal (FIG. 3(A) bears the high level. This will preclude the generation of noises which are normally generated at the initiation of the speaker activation or at the termination of the speaker activation.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An piezo-electric speaker drive system comprising:
an piezo-electric speaker;
a microcomputer including;
a first output terminal for developing a frequency signal for activating said piezo-electric speaker, and
a second output terminal for developing a gate signal for controlling the application of said frequency signal to said piezo-electric speaker, and
a PNP transistor disposed between said microcomputer and said piezo-electric speaker;
the base electrode of said PNP transistor being commonly connected to said first and second output terminals of said microcomputer; and
the collector electrode of said PNP transistor being connected to said piezo-electric speaker.

2. The speaker drive system of claim 1 wherein said microcomputer is a P-channel MOS LSI.

3. The speaker drive system of claim 1 wherein said gate signal goes logically low to apply said frequency signal to the electrode of said transistor.

4. A system for generating a desired audible tone from a piezo-electric transducer comprising:
a digital computer continuously developing a frequency clock signal having the frequency of said desired audible tone;
said computer including, processing means for executing a software program to perform a plurality of disparate functions, said processing means developing a gate signal as a said disparate function to activate said piezo-electric transducer; and
means for driving said piezo-electric transducer with said frequency clock signal only when enabled by development of said gate signal by said processing means.

5. The system of claim 4 wherein said digital computer is a P-channel MOS LSI microcomputer.

6. The system of claim 4 wherein said gate signal goes logically low to activate said piezo-electric transducer.

7. The system of claim 4 wherein said gate signal begins and ends when said frequency clock signal is logically high to inhibit generation of undesired noise.

8. A system for generating a desired audible tone from a piezo-electric transducer comprising:
a digital computer continuously developing a frequency clock signal having the frequency of said desired audible tone at a first output terminal;
said computer including, processing means for executing a software program to perform a plurality of disparate functions, said processing means developing a gate signal as a said disparate function to activate said piezo-electric transducer at a second output terminal of said computer;
switch means for selectively applying a voltage across said piezo-electric transducer means in response to application of a control signal to a control terminal thereof; and
means for logically summing said frequency clock signal with said gate signal to develop said control signal, said control signal applying an alternating waveform from said frequency clock signal only when said gate signal is developed.

9. The system of claim 8 wherein said means for logically summing comprises the wired interconnection of said first and second output terminals of said computer to the control terminal of said switch means.

10. The system of claim 9 wherein said switch means is serially connected to said piezo-electric speaker across a voltage source.

11. The system of claim 10 wherein said switch means is a PNP transistor.

12. The system of claim 11 wherein the output of said computer at said second output terminal is normally logically high and goes logically low to produce said gate signal.

13. The system of claim 12 wherein said gate signal begins and ends when said frequency clock signal is logically high to inhibit generation of undesired noise.

14. The system of claim 4 wherein said system forms part of a microwave oven, said processing means performing disparate microwave oven control functions.

15. The system of claim 14 wherein said disparate functions include microwave oven cooking control.

16. The system of claim 4 wherein said frequency clock signal is developed independent of operation of said software program.

17. The system of claim 8 wherein said system forms part of a microwave oven, said processing means performing disparate microwave oven control functions.

18. The system of claim 17 wherein said disparate functions include microwave oven cooking control.

19. The system of claim 8 wherein said frequency clock signal is developed independent of operation of said software program.

20. A method of controlling the development of an audible tone using a piezo-electric transducer including:
continuously generating a frequency signal from a microcomputer;
controlling the application of said frequency signal to said piezo-electric transducer with a timing control signal developed by said microcomputer under control of a software program;
said continuously generated frequency signal being generated without control by a software program.

* * * * *